US006766971B2

(12) United States Patent
Van Der Beek et al.

(10) Patent No.: US 6,766,971 B2
(45) Date of Patent: Jul. 27, 2004

(54) METHOD AND INSTALLATION FOR COMMINUTING SCRAP MATERIAL

(75) Inventors: August Van Der Beek, Grevenbroich (DE); Erich Köhl, Meerbusch (DE); Rainer Voss, Leverkusen (DE); Bernhard Kock, Moers (DE)

(73) Assignee: Metso Lindemenn GmbH, Dusseldorf (DE)

( * ) Notice: Subject to any disclaimer, the term of this patent is extended or adjusted under 35 U.S.C. 154(b) by 0 days.

(21) Appl. No.: 10/215,415

(22) Filed: Aug. 8, 2002

(65) Prior Publication Data

US 2003/0038194 A1 Feb. 27, 2003

Related U.S. Application Data

(63) Continuation of application No. PCT/DE01/04257, filed on Nov. 15, 2001.

(51) Int. Cl.[7] ..... B02C 25/00

(52) U.S. Cl. ..... 241/30; 241/32; 241/34; 241/285.2

(58) Field of Search ..... 241/27, 33, 34, 241/35, 36, 285.1, 285.2, 285.3, 186.35, 30, 32

(56) References Cited

U.S. PATENT DOCUMENTS 3,825,192 A * 7/1974 Knight ..... 241/186.35
3,905,557 A 9/1975 Grommes
4,529,134 A 7/1985 Williams
4,625,924 A * 12/1986 Killinger ..... 241/186.35
4,709,197 A 11/1987 Goldhammer
5,443,568 A 8/1995 Popovich
5,863,003 A 1/1999 Smith

FOREIGN PATENT DOCUMENTS

WO WO 00 45958 8/2000

* cited by examiner

*Primary Examiner*—Mark Rosenbaum
(74) *Attorney, Agent, or Firm*—Norris McLaughlin & Marcus, PA; Christa Hildebrand

(57) ABSTRACT

A method and an installation for operating a system for comminuting scrap material is provided. The installation includes a supply device (1) for the scrap material to be comminuted, and a comminuting machine (2) with at least one motor-driven (2.3) rotor (2.2) which has comminuting tools (2.2.1) and is horizontally positioned in a housing (2.1) and has an ejection door (2.1.1). The inventive installation also includes drive means for controlling the power and for protecting the installation from scrap material which is difficult to comminute or which cannot be comminuted at all, such as coarse, heavy or hard parts. For optimizing the comminuting process, the values of the motor output, of the rotation speed of the rotor, of the temperature of the motor and the motor bearings and/or of the height of the scrap material flow (3) supplied to the comminuting machine (2), are inputted in a controller (4) and used to control/regulate the scrap material supply. Technical means (4.5, 4.6, 4.7) are provided in the region of the housing (2.1) for ejecting coarse, heavy or hard parts.

16 Claims, 3 Drawing Sheets

METHOD AND INSTALLATION FOR COMMINUTING SCRAP MATERIAL

RELATED APPLICATIONS

This application is a continuation application of International Application PCT/DE01/04257 filed on Nov. 15, 2001 and claims priority of German Application 100 56 637.5 filed on Nov. 15, 2000.

BACKGROUND OF THE INVENTION

1. Field of the Invention

The invention relates to a method and an installation for comminuting scrap material. The installation includes a supply device for the scrap material to be comminuted. It also includes a comminution machine with at least one motor-driven rotor, which is horizontally supported in a housing and has comminution tools and drive means, means for controlling the power and means for protecting the installation from scrap material which is difficult to comminute or cannot be comminuted at all, such as coarse, heavy or hard parts 2. Description of the Related Art Comminution machines for comminuting scrap metal, such as wood, bulky refuse and the like, are known in different embodiments and with different operating characteristics, as disclosed in DE-A-28 19 611, EP-B1-0 203 272, EP-B1-0 768 920, EP-B1-0 930 941 and U.S. Pat. No. 5,863,003. During the actual operation of such machines, in particular, when a supply device is arranged upflow, and therefore of an entire installation, there is always the problem of achieving the projected parameters for the comminution power, since the aforedescribed scrap materials contain certain fractions which are difficult to comminute or cannot be comminuted at all, and which cannot be estimated.

SUMMARY OF THE INVENTION

It is therefore an aspect of the invention to provide a method and an installation whereby the comminution process is optimized by providing control means and, in addition, through constructive modifications of the geometry.

The method utilizes using a supply device for the scrap material to be comminuted, a comminution machine with at least one motor-driven rotor, horizontally supported in a housing having an ejection door and including comminution tools and a drive means. Further, the method utilizes means for controlling the power and means for protecting the installation from scrap material that is difficult to comminute or cannot be comminuted at all. For that data values of the motor output, speed of rotations of the rotor, the motor temperature and motor bearing temperature and/or the height of the scrap material flow which is supplied to the comminution machine, is inputted in a controller and used for controlling/regulating the supply of the scrap material. Technical means are provided in the region of the housing for ejecting the coarse, heavy or hard parts. Accordingly, the installation for carrying out the method includes a supply device, a comminution machine with at least one motor-driven rotor, horizontally supported in a housing. It further includes an inlet and an outlet for the material to be comminuted, comminution tools, drive means, control means and means for protecting the installation as well as an ejection door for ejecting coarse, heavy or hard parts. A controller controls/regulates the supply device. A measuring element interacts with the housing and the controller, and is connected to the measuring element for ejecting coarse, heavy or hard parts.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
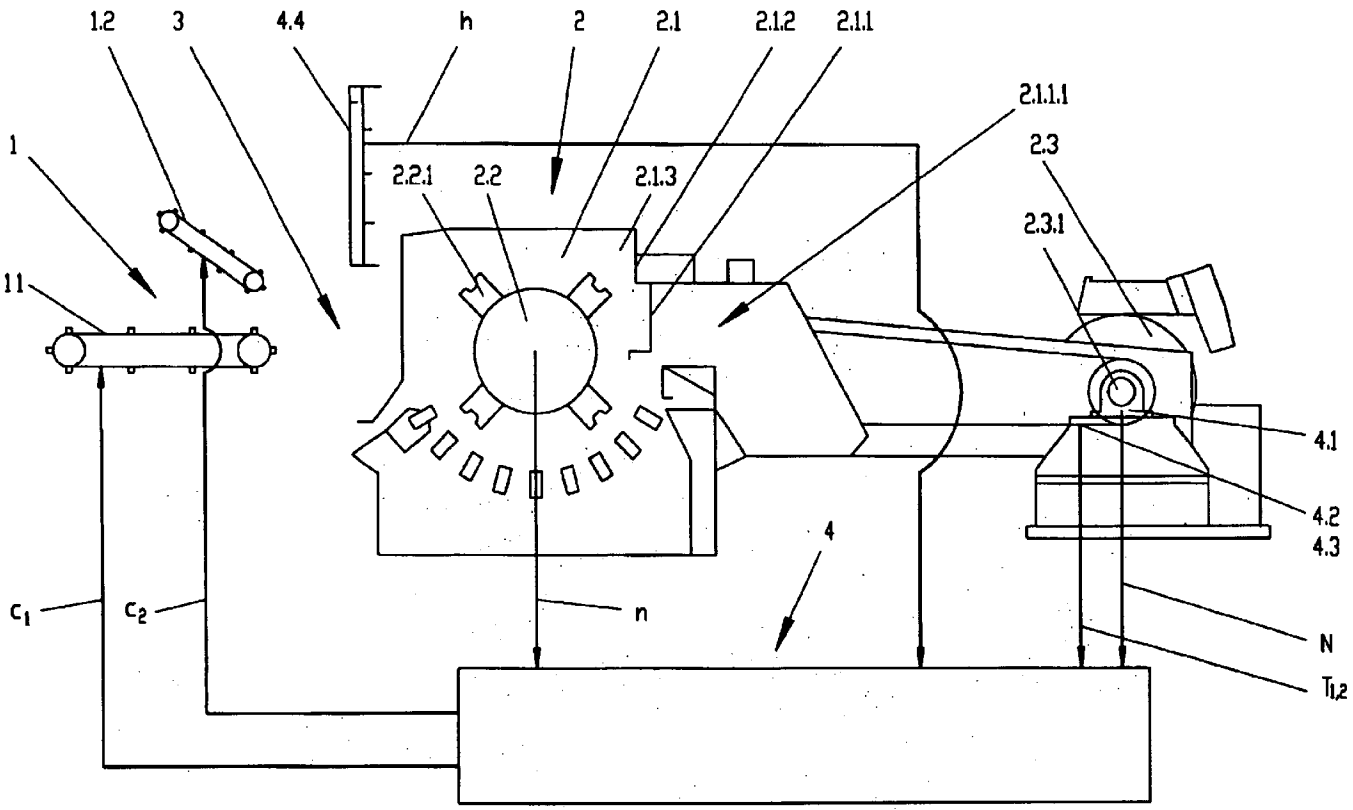
FIG. 1 illustrates the comminution installation with a controller controlling certain functions.
Figure 2:
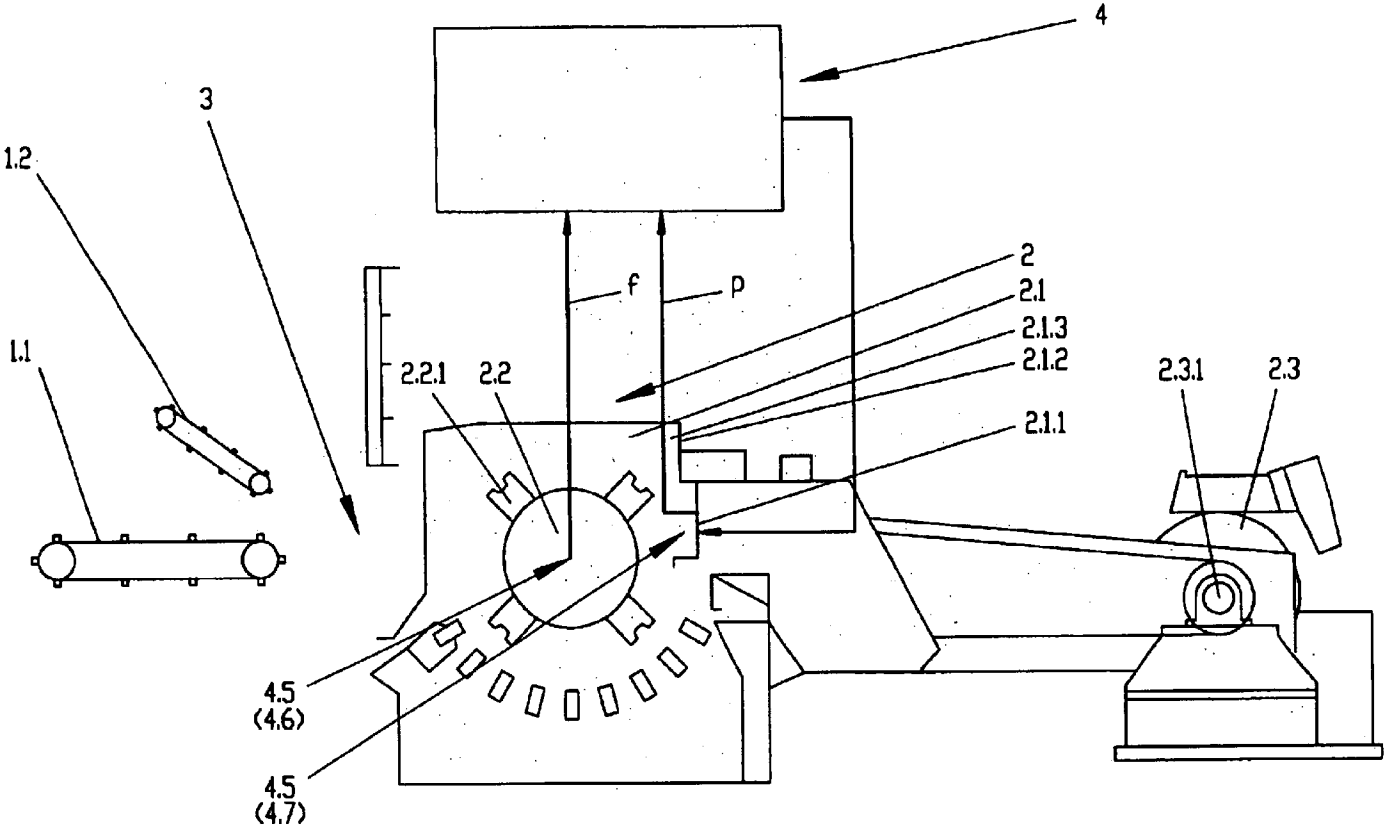
FIG. 2 illustrates the comminution installation with a controller controlling additional functions.
Figure 3:
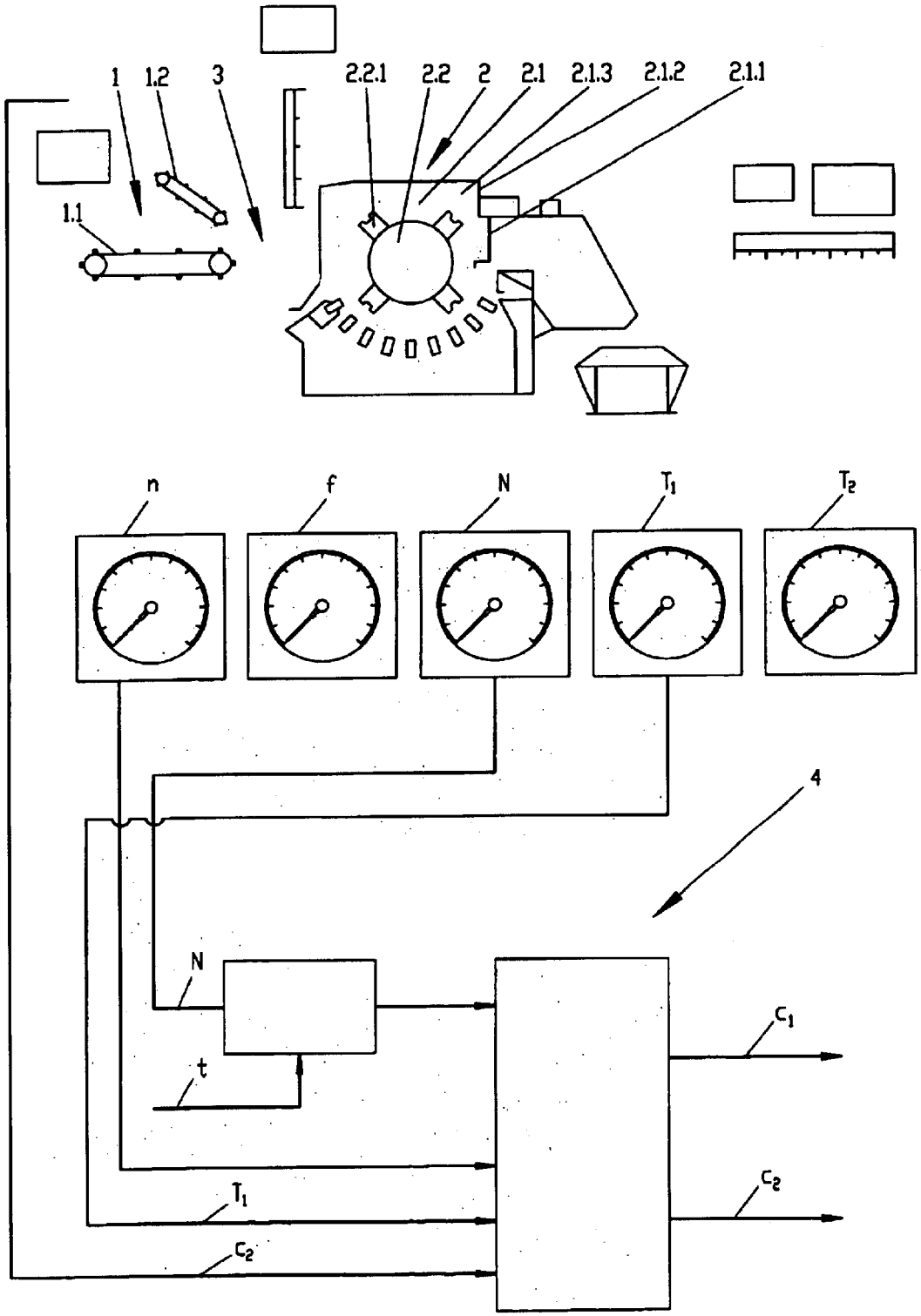
FIG. 3 illustrates the logic circuit for controlling the ejection door and for interrupting and starting the scrap material supply.

In the Figures, the following reference numerals are used 1=supply device; 1.1=supply belt; 1.2=forced loading; 2=comminution machine; 2.1=housing; 2.1.1=ejection door; 2.1.1.1=drive elements; 2.1.2=adjusting element 2.1.3=corner dead space; 2.2=rotor; 2.2.1=comminution tools 2.3=motor; 2.3.1=motor bearing; 3=scrap material flow; 4=controller; 4.1=first transducer 4.2=second transducer; 4.3=third transducer; 4.4=fourth transducer; 4.5=measuring element; 4.6=vibration sensor; 4.7=pressure sensor; n=rotor rotation speed N=motor output; $T_1$=motor temperature; $T_2$=motor bearing temperature; $C_1$=speed of supply belt; $C_2$=speeds of forced loading; h=height of supplied scrap material flow; t=time and $\Delta P$=pressure difference (pressure gradient);

Accordingly, a comminution machine 2 is shown in FIGS. 1 and 2, with a supply device 1 with a motor-driven 2.3 rotor 2.2, which is horizontally supported in a housing 2.1 with an inlet for the material and an outlet for the material, and comminution tools 2.2.1 and drive elements 2.1.1.1 and a controller 4 and means for protecting the installation as well as an ejection 2.1.1 door for ejecting coarse, heavy or hard parts. The controller 4 controls/regulates the supply device 1. A measuring element 4.5 interacts with the housing 2.1, and the controller 4 connected to the measuring element 4.5 for ejecting coarse, heavy or hard parts. An adjusting element 2.1.2 is arranged in the housing 2.1 for changing the geometry of the interior space of the housing 2.1. The supply device 1 comprises a supply belt 1.1 and a forced loading arrangement 1.2. The controller (4) is connected with a first transducer 4.1 for measuring the motor output N, with a second transducer 4.2 for measuring the motor temperature $T_1$, with a third transducer 4.3 for measuring the motor bearing temperature $T_2$ and/or with a fourth transducer 4.4 for measuring the height h of the scrap material flow 3 supplied to the comminution machine 2. A connection exists from the controller 4 is provided to the supply device 1 for controlling the speed of the supply device 1. A measuring element 4.5 is a vibration sensor 4.6 connected with the controller 4, wherein the controller 4 is connected with a drive element 2.1.1.1 for controlling the ejection door 2.1.1 on the housing 2.1. A measuring element 4.5 is a pressure sensor 4.7 connected with the controller 4, wherein the controller 4 is connected with the drive element 2.1.1.1 for controlling the ejection door 2.1.1. The adjusting element 2.1.2 for changing the geometry of the interior space in the housing 2.1 is a component, which slants a corner dead space 2.1.3 above the ejection door 2.1.1 to the upper cover of the housing 2.1. The ejection door 2.1.1 is supported by at least one element, such as a rupture bolt with a rated break point, wherein the rated break point is sized so that the coarse, heavy or hard parts can pass through the ejection door 2.1.1 to the outside as a result of the built-up pressure.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for operating an comminuting scrap material installation, comprises the steps of providing a supply device for the scrap material to be comminuted;

providing a comminution machine with at least one motor-driven rotor;

supporting the motor-driven rotor horizontally in a housing;

providing an ejection door in the housing;

providing comminution tools and drive means, a power controller and means for protecting the installation from scrap material that does not comminute;

determining values representative of motor output, rotation speed of the rotor, motor temperature sad motor bearing temperature;

inputting in the determined values into a controller;

using the controller for controlling the supply of the scrap material; and providing measuring means, a vibration sensor and a pressure sensor in the region of the housing for ejecting coarse, heavy and hard parts.

2. The method according to claim 1, further comprising the steps of determining the height of the scrap material flow supplied to the comminution machine.

3. The method according to claim 1, further comprising the step of regulating the comminution process by utilizing a mechanical adjusting element in the housing for changing the geometry of the interior space of the housing.

4. The method according to claim 1, further comprising the step of determining from the vibration values provided to the controller the vibration amplitude as a function of the frequency and time.

5. The method according to claim 4, further comprising the step of detecting and evaluating a vibration pattern and using the pattern for recognizing scrap material that is does not comminute and for controlling an ejection of coarse, heavy and hard parts and for interrupting and starting the supply of the scrap material.

6. The method according to claim 1, wherein the values representing an increase of the pressure against the ejection door in the housing are provided to the controller, evaluated and used for recognizing scrap material that does not comminute and for controlling an ejection of coarse, heavy and hard parts and for interrupting and starting the supply of the scrap material.

7. The method according to claim 1, further comprising the step of utilizing values of the motor temperature and motor bearing temperature, the motor output, the rotor rotation speed and/or the height of the scrap material flow supplied to the comminution machine, for controlling the speed ($C_1$, $C_2$) of a corresponding supply belt and a forced loading for the scrap material.

8. The method according to claim 1, further comprising the step of utilizing a software for a plant monitoring system with functions of control/regulation of the supply of the scrap material based on measured values for the controller of the motor output, the rotor rotation speed, the motor temperature and motor bearing temperature and/or the height (h) of the scrap material flow (3) supplied to the comminution machine (2); controlling of the ejection of coarse, heavy and hard parts and as regulation of the supply of the scrap material from the values measured for the controller on the comminution machine, and regulating the comminution process in the housing by way of a mechanical adjusting element for changing the geometry of the interior space of the housing.

9. A scrap material installation for comminuting scrap material, comprising a supply device, a comminution machine with at least one motor-driven rotor operated in only one direction and horizontally supported in a housing having an inlet for the material and an outlet for the material, and which includes comminution tools and drive means and control means and means for protecting the installation as well as an ejection door for ejecting coarse, heavy or hard parts, and a controller for controlling/regulating the supply device and at least one measuring element which interacts with the housing, and the controller connected to the at least one measuring element for ejecting coarse, heavy or hard parts.

10. The scrap material installation according to claim 9, wherein at least one adjusting element is arranged in the housing for changing the geometry of the interior space of the housing.

11. The scrap material installation according to claim 9, wherein the supply device comprises a supply belt and a forced loading arrangement.

12. A scrap material installation for comminuting scrap material, comprising a supply device, a comminution machine with at least one motor-driven rotor, which is horizontally supported in a housing having an inlet for the material and an outlet for the material, and which includes comminution tools and drive means, control means, means for protecting the installation and an ejection door for ejecting coarse, heavy or hard parts;

a controller for controlling/regulating the supply device;

at least one measuring element which interacts with the housing, and the controller connected to the at least one measuring element for ejecting coarse, heavy or hard parts and, wherein the controller is connected with a first transducer for measuring the motor output, with a second transducer for measuring the motor temperature, with a third transducer for measuring the motor bearing temperature and with a fourth transducer for measuring the height of the scrap material flow supplied to the comminution machine, and wherein at least one connection exists from the controller to the supply device for controlling the speed of the supply device.

13. The scrap material installation according to claim 12, wherein at least one measuring element is a vibration sensor connected with the controller, and wherein the controller is connected with a drive element for controlling the ejection door on the housing.

14. The scrap material installation according to claim 12, wherein at least one measuring element is a pressure sensor connected with the controller, and wherein the controller is connected with the drive element for controlling the ejection door.

15. The scrap material installation according to claim 12, wherein the adjusting element for changing the geometry of the interior space in the housing is a component, which slants a corner dead space above the ejection door to the upper cover of the housing.

16. The scrap material installation according to claim 12, wherein the ejection door is supported by at least one rupture bolt with a rated break point and wherein the rated break point is sized so that the coarse, heavy or bard parts can pass through the ejection door to the outside as a result of the built-up pressure.

* * * * *